US008164550B2

(12) United States Patent
Miyazawa et al.

(10) Patent No.: US 8,164,550 B2
(45) Date of Patent: Apr. 24, 2012

(54) LIQUID CRYSTAL DISPLAY DEVICE

(75) Inventors: Toshio Miyazawa, Chiba (JP); Hideo Sato, Hitachi (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 977 days.

(21) Appl. No.: 11/670,060

(22) Filed: Feb. 1, 2007

(65) Prior Publication Data

US 2007/0182689 A1 Aug. 9, 2007

(30) Foreign Application Priority Data

Feb. 3, 2006 (JP) ..... 2006-026498

(51) Int. Cl.
*G09G 3/36* (2006.01)

(52) U.S. Cl. ..... 345/87; 345/90; 345/98

(58) Field of Classification Search ..... 345/204–205, 345/87–88, 98–99
See application file for complete search history.

(56) References Cited

U.S. PATENT DOCUMENTS

| | | | | |
|---|---|---|---|---|
| 5,952,991 | A * | 9/1999 | Akiyama | 345/98 |
| 6,742,762 | B2 * | 6/2004 | Koyama | 251/59 |
| 6,778,162 | B2 * | 8/2004 | Kimura et al. | 345/90 |
| 6,930,666 | B2 * | 8/2005 | Miyazawa et al. | 345/100 |
| 6,937,222 | B2 * | 8/2005 | Numao | 345/98 |
| 7,057,596 | B2 | 6/2006 | Miyazawa | |
| 7,091,749 | B2 * | 8/2006 | Miyake et al. | 326/88 |
| 7,123,229 | B2 * | 10/2006 | Toyozawa et al. | 345/90 |
| 7,362,139 | B2 * | 4/2008 | Miyake et al. | 326/88 |
| 7,692,614 | B2 | 4/2010 | Miyazawa | |
| 7,746,308 | B2 * | 6/2010 | Toyozawa et al. | 345/90 |
| 2004/0135760 | A1 * | 7/2004 | Miyazawa et al. | 345/99 |

FOREIGN PATENT DOCUMENTS

| | | |
|---|---|---|
| JP | 2002-229532 | 8/2002 |
| JP | 2004-252307 | 9/2004 |
| JP | 2005-077864 | 3/2005 |

* cited by examiner

*Primary Examiner* — Jason Mandeville
(74) *Attorney, Agent, or Firm* — Antonelli, Terry, Stout & Kraus, LLP.

(57) ABSTRACT

In a display device used in a compact mobile apparatus that uses a battery or the like as the poser supply, the display device consumes less power even when the display state is not switched for a long period of time. A memory element is provided in each pixel, but the number of the parts does not increase and the aperture ratio is maintained at a high level. A low power-consumption liquid crystal display device is achieved by providing the memory element in each pixel and transferring no image signal. The voltage held in the pixel memory in the liquid crystal display panel is used to generate an alternating drive signal in the pixel. Even when the image signal is not rewritten, the alternating drive avoids liquid crystal degradation and performs display operations. The simply configured memory element allows a liquid crystal display device without aperture ratio penalty to be achieved.

8 Claims, 7 Drawing Sheets

LIQUID CRYSTAL DISPLAY DEVICE

BACKGROUND OF THE INVENTION

1. Field of the Invention

The invention relates to an active-matrix display device, which is particularly suitable for a display device capable of high-aperture and small-sized pixel memory-based display operations.

2. Description of the Related Art

A TFT (Thin Film Transistor) liquid crystal display device with a switching element in each pixel is widely used as the display device of a personal computer and the like. Such a TFT display device is also used as the display device of a mobile terminal, such as a mobile phone. The display device used in a mobile terminal needs to be more compact and consume less power than conventional liquid crystal display devices.

Particularly, when the power supply of a mobile terminal is a battery or the like, the display device, like other components, needs to reduce power consumption. To this end, it has been proposed to impart a memory capability to each pixel of the liquid crystal display device.

U.S. Pat. No. 7,057,596 describes a capacitor connected not only to two pairs of transistors that holds an image signal but also to a pixel electrode. In this document, the charge accumulated in the capacitor is used to control the data write state. However, in U.S. Pat. No. 7,057,596, a static RAM is used to hold data, and no consideration is given to the increased area occupied by a circuit using an inverter circuit formed of a pair of transistors.

SUMMARY OF THE INVENTION

On the other hand, a display device needs to provide higher transmission aperture ratio. To this end, transistors and the like desirably take up less area in a pixel. Furthermore, there is a need for a stable and reliable memory operation.

The invention has been made to solve the above problems and aims to provide a technology by which a drive circuit that consumes less power and uses an optimum number of parts can be achieved in a compact display device.

These and other objects and novel features of the invention will become apparent from the following description herein and accompanying drawings.

The representative embodiments of the invention disclosed in this application are briefly summarized as follows:

A single substrate includes a pixel having a pixel electrode, a switching element that supplies an image signal to the pixel, a drive circuit that supplies the image signal to the switching element, a drive circuit that outputs a scan signal and a memory circuit provided in the pixel. The memory circuit uses a capacitive element to hold a voltage. The voltage held in the memory circuit is used to output a display voltage or a non-display voltage to the pixel electrode. The voltage of the image signal is designed to have an optimum value in consideration of the voltage held in the memory circuit.

The circuit scale of the pixel memory can be reduced and space can be saved in terms of pixel layout.

A liquid crystal display device is provided with pixels. Each pixel is provided with a pixel electrode and a memory element. A counter electrode is provided opposite to the pixel electrode. There are also provided a switching element that supplies an image signal to the pixel, an image signal line that supplies the image signal to the switching element, a scan signal line that supplies a scan signal that controls the switching element, a memory element connected to the switching element, and an output circuit provided between the memory element and the pixel electrode.

Alternating drive is performed by applying an alternating voltage that periodically repeats a low level and a high level to the counter electrode.

The switching element is turned on and the capacitance of the memory element is used to hold a latch voltage based on the image signal. After the switching element is turned off, the latch voltage held in the memory element allows the output circuit to output a display voltage having a phase opposite to the alternating voltage or a non-display voltage in phase with the alternating voltage.

An appropriate voltage depending on the display/non-display state is applied to the control terminal of the output circuit.

DETAIL DESCRIPTION OF THE EMBODIMENTS

Figure 1:
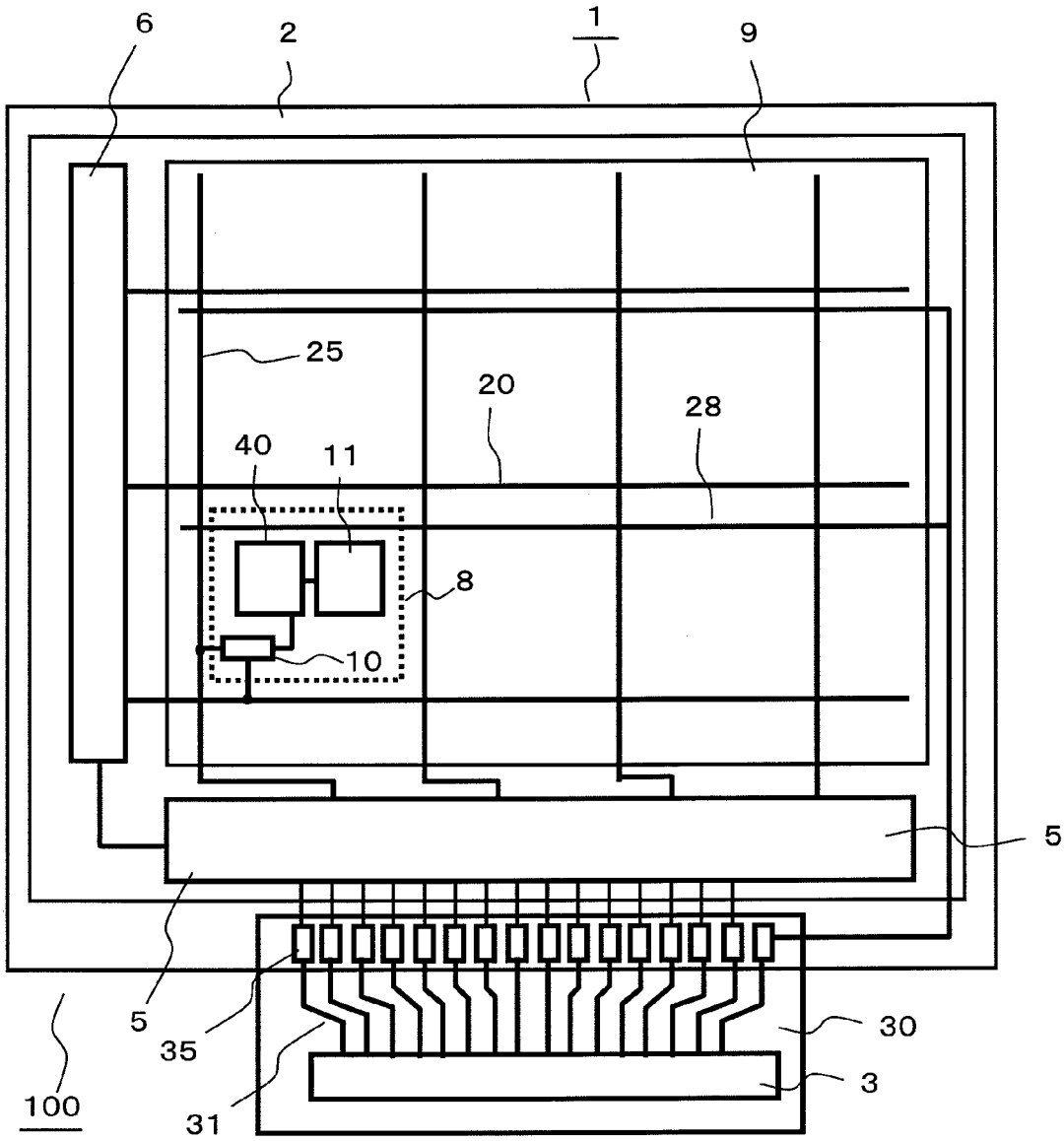
FIG. 1 is a schematic block diagram showing the liquid crystal display device according to an example of the invention.

An example of the invention will be described below in detail with reference to the drawings. Throughout the drawings for explaining the embodiment, portions having the same functions have the same reference characters and redundant description thereof will be omitted.

FIG. 1 is a block diagram showing the basic configuration of the liquid crystal display device according to the example of the invention. As shown in FIG. 1, the liquid crystal display device 100 includes a liquid crystal display panel 1 and a control circuit 3.

The liquid crystal display panel 1 includes an element substrate 2 formed of an insulating substrate or a semiconductor substrate. The element substrate 2 is made of transparent glass, plastic or the like. The element substrate 2 has pixels 8 arranged in a matrix to form a display area 9. (In FIG. 1, one pixel is illustrated and the other pixels are omitted for clarity of the figure.) The pixel 8 includes a pixel electrode 11, a switching element 10 and a memory element 40.

An image signal line drive circuit 5 and a scan signal line drive circuit 6 are formed at the periphery of the display area 9 along the edges of the element substrate 2. The image signal line drive circuit 5 and the scan signal line drive circuit 6 are formed on the element substrate 2 in a process similar to that of the switching element 10.

Scan signal lines 20 extend from the scan signal line drive circuit 6 over the display area. Each scan signal line 20 is in electrical contact with the control terminal of the switching element 10. The scan signal line drive circuit 6 outputs a control signal (also referred to as a scan signal) onto the scan signal line 20 that turns the switching element 10 on and off.

On the other hand, image signal lines 25 extend from the image signal line drive circuit 5 over the display area 9 and each image signal line 25 is in contact with the input terminal of the switching element 10. The image signal line drive circuit 5 outputs an image signal onto the image signal line 25, and the image signal is written to the pixel 8 via the switching element 10 that has been turned on by the scan signal. The image signal is also supplied to the memory element 40.

The liquid crystal display panel 1 is connected to a flexible substrate 30, on which the control circuit 3 is mounted. The control circuit 3 has a capability of controlling drive circuits provided in the image signal line drive circuit 5 and the scan signal line drive circuit 6, and supplies control signals, image signals and the like to the liquid crystal display panel 1 via the flexible substrate 30.

The flexible substrate 30 is provided with display wiring lines 31, which are in electrical contact with the display panel 1 via input terminals 35. Signals for controlling the display panel 1 are supplied from the control circuit 3 via the display wiring lines 31.

A signal line indicated by reference numeral 28 and provided parallel to each of the scan signal lines 20 is a control signal line, through which a signal for controlling and driving the memory element 40 is supplied from the control circuit 3 to the display panel 1.

The memory element 40 in the pixel 8 holds data (voltage) indicative of the display or non-display state based on the image signal. When a still image is displayed, the image signal line drive circuit 5 is not used, but the display voltage is written from the memory element 40 to the pixel electrode 11.

As described above, a compact mobile apparatus, such as a mobile phone, typically uses a battery as the power source. Thus, the display device also desirably consumes less power. Power saving can be achieved by providing the memory element 40 in the pixel 8 and reducing the power consumed when an image signal is transferred.

Figure 2:
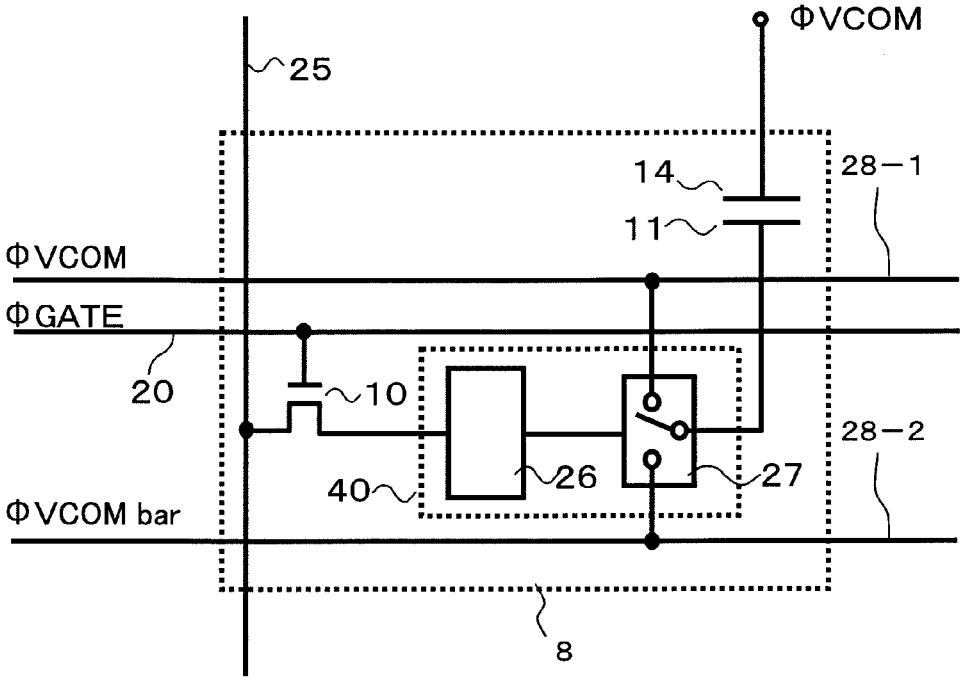
FIG. 2 is a schematic block diagram showing the pixel memory according to the example of the invention.

The switching element 10 and the memory element 40 used in the pixel 8 will now be described with reference to FIG. 2. FIG. 2 is a schematic block diagram showing the switching element 10 and the memory element 40 in each pixel. In FIG. 2, reference numeral 26 denotes a data latch element that holds 1-bit data indicative of the display/non-display state. In the power saving display mode, 1-bit fixed voltage (high or low voltage) data is first supplied from the image signal line drive circuit 5 shown in FIG. 1 to the pixel 8 via the image signal line 25.

The switching element 10 is controlled by the scan signal ΦGATE and 1-bit data is stored in the data latch element 26 via the on-state switching element 10. A display-voltage output element 27 outputs a voltage according to the stored 1-bit data to the pixel electrode 11.

A liquid crystal composition material (not shown) is held between the pixel electrode 11 and a counter electrode 14. To perform a display operation, an electric field is applied between the pixel electrode 11 and the counter electrode 14 to change the orientation of the liquid crystal molecules.

Alternating drive is used to drive the liquid crystal display panel 1 in order to prevent degradation of the liquid crystal composition material. The alternating drive is an operation in which the direction of the electric field applied between the pixel electrode 11 and the counter electrode 14 is periodically reversed, so that a unidirectional electric field will not be applied to the liquid crystal composition material for a long period of time.

As described above, the circuit shown in FIG. 2 stores the 1-bit data in the data latch element 26 and outputs a voltage according to the stored 1-bit data from the display-voltage output element 27 to the pixel electrode 11. Thus, the display-voltage output element 27 outputs either of two voltages, that is, display voltage or non-display voltage, according to the value of the 1-bit data.

It should be noted that the display state and the non-display state are associated with each other. That is, the display state means that the potential difference between the voltage applied to the counter electrode 14 (counter voltage) and the voltage applied to the pixel electrode 11 is greater than that in the non-display state, while the non-display state means that the potential difference is smaller than that in the display state. In this example, for clarity of the description, the display state (display voltage) is described as a state in which the potential difference between the voltage applied to the counter electrode 14 and the voltage applied to the pixel electrode 11 becomes maximum, while the non-display state (non-display voltage) is described as a state in which the potential difference becomes minimum.

Thus, the display-voltage output element 27 will receive the voltage ΦVCOM, which is the same voltage as that applied to the counter electrode 14, via the control signal line 28-1 or the voltage ΦVCOMbar, which is obtained by reversing the voltage ΦVCOM, via the control signal line 28-2.

Figure 3:
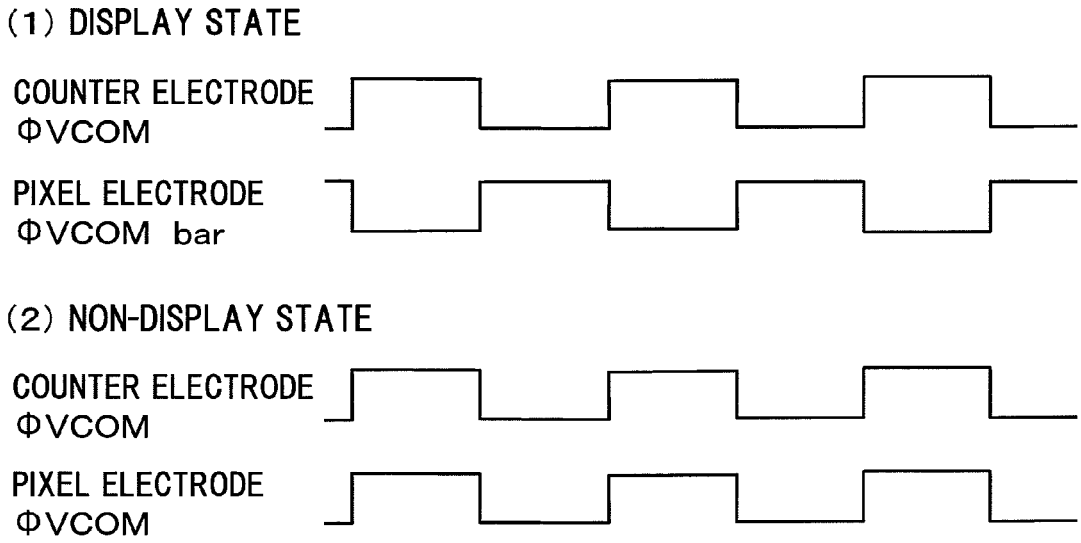
FIG. 3 is a schematic view showing the drive waveforms according to the invention.

FIG. 3 shows signal waveforms supplied to the counter electrode 14 and the pixel electrode 11 in a common inversion drive mode. In the so-called common inversion drive mode, as shown in FIG. 3, the counter voltage ΦVCOM applied to the counter electrode 14 will be periodically inverted to perform the alternating drive.

In the display state (1) shown in FIG. 3, the opposite-phase signal (the same signal as ΦVCOMbar) obtained by inverting the counter voltage ΦVCOM is applied to the pixel electrode, while in the non-display state (2), a signal in phase with the counter voltage ΦVCOM (the same signal as ΦVCOM) is applied to the pixel electrode.

As described above, provision of the memory element 40 allows the data held in the data latch element 26 to be used to perform a power-saving display operation. Furthermore, the alternating voltages ΦVCOM and ΦVCOMbar are written to the pixel electrode 11 in order to perform the alternating drive based on the held data, allowing the alternating drive in a simple configuration.

Figure 4:
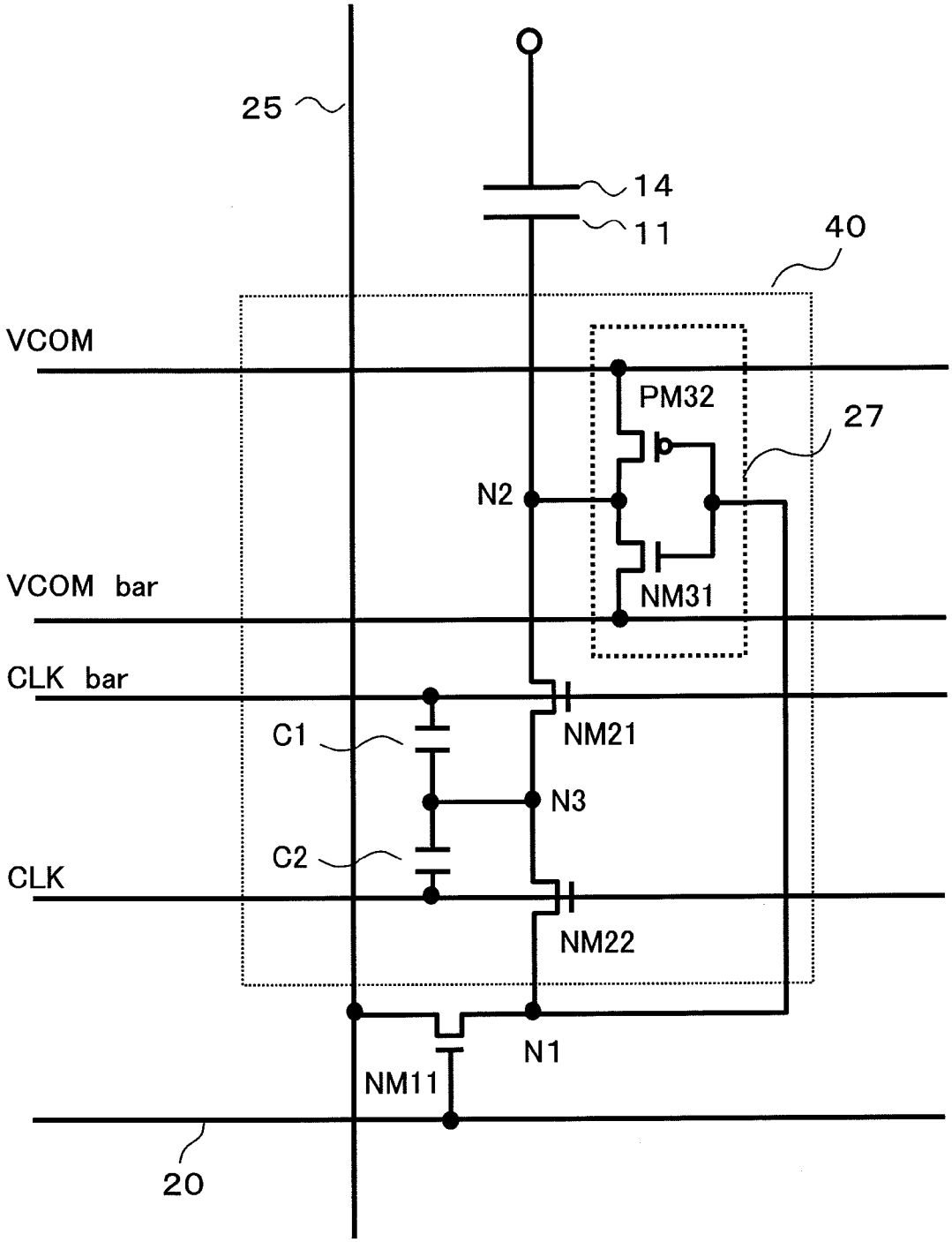
FIG. 4 is a circuit diagram showing the pixel memory according to the invention.

FIG. 4 shows the circuit configuration of the unit pixel memory according to the invention. Although reference numeral NM11 in the figure denotes the switching element 10 described above, the switching element 10 is represented by the reference numeral NM11 in order to explain the circuit configuration. Reference numeral 11 denotes the pixel electrode and the counter electrode 14 is disposed opposite to the pixel electrode. The clock pulses (rectangular wave, alternating current) ΦVCOM that periodically repeat the high level and low level of the signal voltage are applied to the counter electrode 14 in order to perform the common alternating drive described above.

The switching element NM11 is turned on and off by the scan signal ΦGATE (see FIG. 5) on the scan signal line 20. Since the switching element NM11 is shown as an n-type transistor in FIG. 4, the high-level scan signal ΦGATE brings the switching element NM11 into the conduction state, while the low-level scan signal ΦGATE brings it into a high-resistance state. When the switching element NM11 is turned on, the image signal DATA transmitted through the image signal line 25 is transferred to a node N1.

In FIG. 4, the memory element 40 includes one pMOS transistor indicated by reference numeral PM32, three nMOS transistors indicated by reference numerals NM21, NM22 and NM31, two capacitors indicated by reference numerals C1 and C2 and control signal lines (hereinafter also referred to as control lines) indicated by reference numerals VCOM, VCOMbar, CLK and CLKbar.

In FIG. 4, although one portion is formed by connecting the pMOS transistor PM32 and the nMOS transistor NM31, the other portions are formed of nMOS transistors. This configuration reduces use of contact holes and wiring material (such as aluminum) required for connecting an n-type transistor and a p-type transistor. Conventionally, the configuration around a contact hole occupies a large area in terms of layout, thereby preventing pixel size reduction.

The memory element 40 shown in FIG. 4 is configured to use the capacitance C1 and C2 as well as the capacitance of each node to hold the image signal indicative of the display or non-display state. In this configuration, by minimizing the area for contact holes and the like, the footprint of the memory element in the pixel can be reduced, as compared to the configuration of a static RAM that uses an inverter circuit in which a pMOS transistor and an nMOS transistor are connected to each other.

The memory element 40 uses capacitance C1 and C2 as well as the capacitance of each node to hold an image signal (digital data) indicative of the display or non-display state as an arbitrary voltage value (analog data). Thus, the voltage held in the memory element 40 is determined in consideration of the values of each capacitance and the voltage of each signal such that the display-voltage output element 27 (hereinafter also referred to as a display-voltage output circuit) outputs the display or non-display voltage.

The pMOS transistor PM32 and the nMOS transistor NM31 form the display-voltage output circuit 27, which is controlled by the voltage at the node N1 and outputs the signal supplied from the control signal line VCOM or VCOMbar to the node N2. The nMOS transistor NM21 electrically connects the node N2 to the capacitor C1+C2 (representing the capacitors C1 and C2 serially connected to each other), while the nMOS transistor NM22 electrically connects the capacitor C1+C2 to the node N1.

The capacitor C1+C2 repeats charging and discharging as well as electrical connection and disconnection to and from the node N1, so that the voltage at the node N1 oscillates at a specific amplitude. The voltage held at the node N1 is set to a voltage that can control the on and off operations of the pMOS transistor PM32 and the nMOS transistor NM31 in the display-voltage output circuit 27. The voltage of the image signal is selected in consideration of the voltage held at the node N1, threshold voltages of the transistors and each capacitance.

Figure 5:
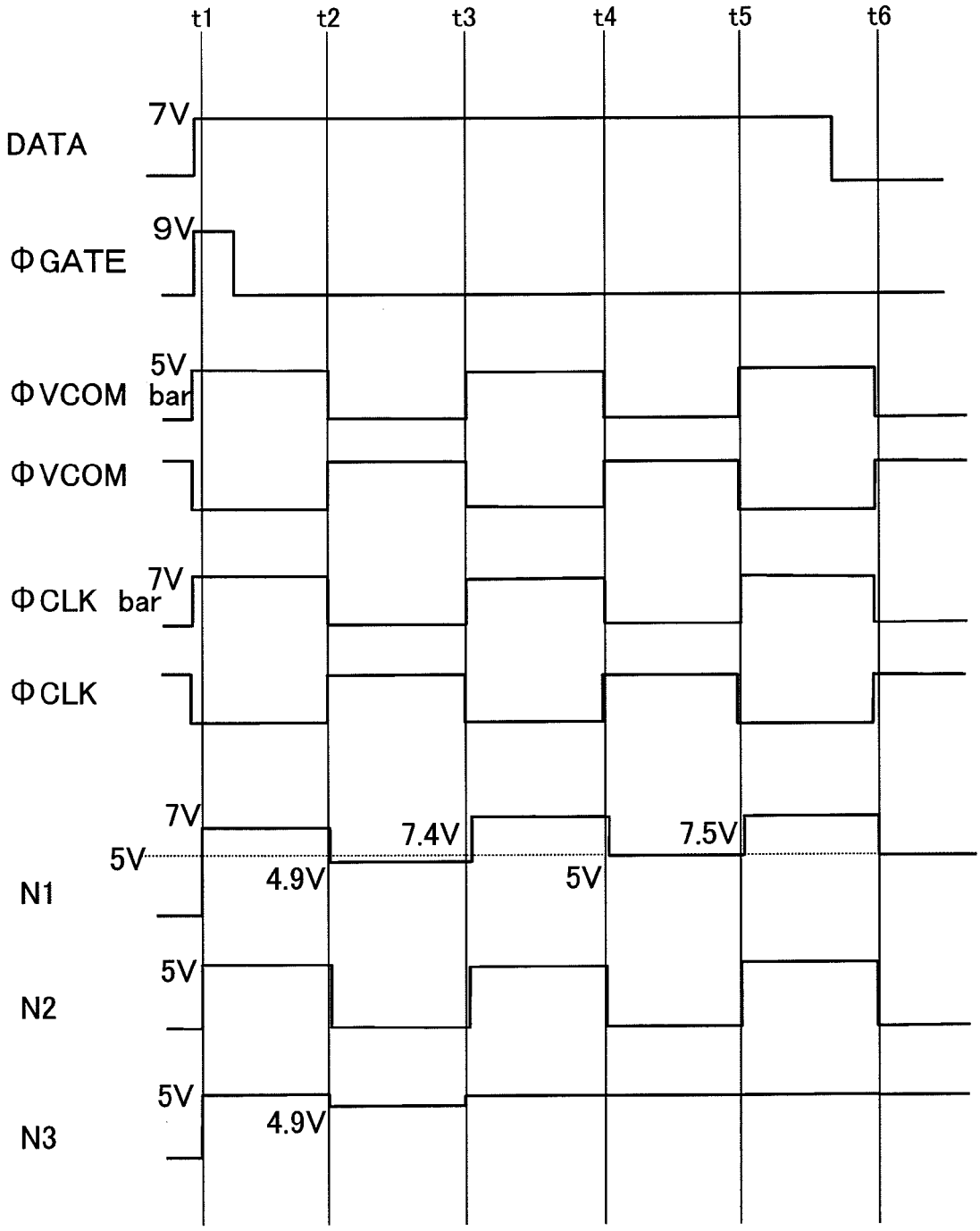
FIG. 5 is a timing chart showing the operation of the example of the invention.

The control lines shown in FIG. 4 will be described with reference to the signals shown in FIG. 5 that are supplied to the control lines. Clock pulses (rectangular waves, also referred to as alternating voltages) ΦVCOM and ΦVCOMbar having opposite phases with respect to each other shown in FIG. 5 are supplied to the control lines VCOM and VCOMbar. Let voltage Vd and voltage Vs be the high voltage and the low voltage of the signals ΦVCOM and ΦVCOMbar, respectively.

Rectangular waves ΦCLK and ΦCLKbar having opposite phases with respect to each other are supplied to the control lines CLK and CLKbar. Let voltage Vd+Vth and voltage Vs be the high voltage and the low voltage of the signals ΦCLK and ΦCLKbar, respectively, where Vth is the threshold value of the nMOS transistor.

In FIG. 4, let C be the gate capacitance Cgs of each transistor; the two capacitors C1 and C2 serially connected between the signals ΦCLK and ΦCLKbar satisfy C1+C2=5C; the parasitic capacitance Cs of the node N1 satisfies Cs=C; and the high voltage of ΦGATE is Vd+Vth+Vth and the high voltage of the image signal DATA is Vd+Vth. The voltage of each of the signals is determined in consideration of the threshold values of the transistors.

As described above, the high and low voltages of the signals ΦVCOM and ΦVCOMbar are Vd and Vs, respectively, and the high voltage of the image signal DATA is set to Vd+Vth. This is because the value of the image signal DATA is determined such that the memory element 40 can hold a voltage that can control the display-voltage output circuit 27 based on the high voltage of the image signal DATA, while the high voltage of the image signal DATA is a smallest possible value.

To make the following description simple, the description will be made of a case where the voltage Vd is 5 V; the voltage Vs is 0 V, the threshold value Vth is 2 V; the high voltage of ΦGATE, Vd+Vth+Vth, is 5V+2V+2V=9V; and the high voltage of the image signal DATA, Vd+Vth, is 5V+2V=7V.

As described above, by writing the clock pulses ΦVCOM or ΦVCOMbar to the pixel electrode 11 in order to perform the alternating drive based on the data held in the memory element 40, the alternating drive can be performed in a simple configuration.

However, to perform the common alternating drive, two levels of voltages, that is, high-level and low-level voltage, will be written to the pixel electrode independent of the value of the image signal DATA. For example, in the case of the image signal DATA indicative of the display state, the high-level voltage needs to be written to the pixel electrode when the voltage at the counter electrode is of the low level, while the low-level voltage needs to be written to the pixel electrode when the voltage at the counter electrode is of the high level. The driving method will be described below in four cases with reference to FIGS. 5 to 8.

FIG. 5 shows waveforms of the signals and voltages at the nodes in order to write the high voltage (7 V) of the image signal DATA to the memory element 40 when the counter voltage ΦVCOM at the counter electrode is of the low level and the control signals on the control signal lines satisfy the following equations: ΦVCOMbar=Vd (high voltage) and ΦVCOM=Vs (low voltage).

At the time t1, the voltage of the scan signal ΦGATE on the scan signal line 20 becomes high (9 V), so that the nMOS transistor NM11 is turned on to capture the high voltage (7 V) of the image signal DATA. Thus, the voltage at the node N1 becomes 7 V.

Since the voltage at the gate terminal of the nMOS transistor NM31 connected to the node N1 also becomes 7 V, the nMOS transistor NM31 is turned on, so that the node N2 is brought into conduction with the control line ΦVCOMbar and hence the voltage at the node N2 becomes 5 V.

At this point, since the control line ΦCLKbar is 7 V, the nMOS transistor NM21 is turned on, so that the voltage at the node N3 becomes 5 V, which is applied to the capacitor C1+C2. On the other hand, since the control line ΦCLK is 0 V, the nMOS transistor NM22 is turned off.

After the voltage of the ΦGATE becomes low so that the nMOS transistor NM11 is turned off, the control lines ΦCLK, ΦCLKbar, ΦVCOM and ΦVCOMbar become 7 V, 0 V, 5 V and 0 V, respectively, at the time t2.

At this point, the nMOS transistor NM21 is turned off and the nMOS transistor NM22 is turned on, so that the node N3 is brought into conduction with the node N1. Since the capacitance of the capacitor C1+C2 is 5C, the amount of charge at the node N3 is 5*5C. Since the parasitic capacitance of the node N1 is C and the gate capacitance of the nMOS transistor NM31 is C, the amount of charge at the node N1 before it is brought into conduction is 7*2C. By letting Vna be the voltage of the node N1 after the conduction, the amount of charge after conduction is expressed by (5+2)C*Vna. Considering that the source voltage of the nMOS transistor NM31 becomes 0V and from the fact that the total amount of charge before and after the conduction does not change, the following equation holds true; 7*2C+5*5C−5*1C=7C*Vna, and hence Vna=34/7=4.9 V. Therefore, the node N1, node N2 and node N3 become 4.9 V, 0 V and 4.9 V, respectively.

At the time t3, the control line ΦCLK becomes 0 V, so that the nMOS transistor NM22 is turned off to electrically isolate the node N1 from the capacitor C1+C2. At this point, ΦCLKbar is 7 V, so that the nMOS transistor NM21 is turned on, and the control lines ΦVCOM and ΦVCOMbar become 0 V and 5 V, respectively.

By letting Vnb be the voltage at the node N1 at the time t3 and considering that the voltage Vna increases the source voltage at the node N2 to 5 V and the parasitic capacitance C of the node N1 and the gate capacitance of the nMOS transistor NM31 are serially connected to provide a capacitance of ½C, the voltage Vnb is determined as follows: Vnb=Vna+ΔV(N2)*½=4.9+5/2=7.4 V.

Since the node N1 becomes 7.4 V, the nMOS transistor NM31 is turned on, so that the voltage of ΦVCOMbar, 5 V, is outputted to the node N2. Since the voltage of ΦCLKbar, which is 7 V, turns nMOS transistor NM21 on, the node N2 is brought into conduction with the node N3, so that the node N3 becomes 5 V, which is applied to the capacitor C1+C2.

At the time t4, the control line ΦCLK becomes 7 V, so that the nMOS transistor NM22 is turned on to connect the node N1 to the capacitor C1+C2. At this point, ΦCLKbar is 0 V, so that the nMOS transistor NM21 is turned off.

The voltage at the node N1 before the node N1 is connected to the node N3 is 7.4V as described above. Therefore, by letting Vnc be the voltage at the node N1 after the connection, the following equation holds true: 7.4*2C+5*5C−5*1C=7C*Vnc, so that Vnc=34.8/7=4.97 V. Therefore, the node N1 becomes about 5 V, and the nodes N2 and N3 become 0 V and 5 V, respectively.

At the time t5, by letting Vnd be the voltage at the node N1 and considering that the voltage Vnc increases the source voltage at the node N2 to 5 V and the parasitic capacitance C of the node N1 and the gate capacitance of the nMOS transistor NM31 are serially connected to provide a capacitance of ½C, the voltage Vnd is determined as follows: Vnd=Vnc+ΔV(N2)*½=5+5/2=7.5 V.

At the time t6, the voltage at the node N1 before the node N1 is connected to the node N3 is 7.5 V. By letting Vne be the voltage at the node N1 after the connection, the following equation holds true: 7.5*2C+5*5C−5*1C=7C*Vne, so that Vne=35/7=5 V. Therefore, the nodes N1, N2 and N3 become 5 V, 0 V and 5 V, respectively.

From then on, the voltage at the node N1 changes back and forth between 5 V and 7.5 V. Therefore, the node N1 keeps supplying the inverted display voltage (signal having a phase opposite to the counter voltage ΦVCOM) to the pixel electrode until ΦGATE becomes the on-voltage and the image signal ΦDATA is written to replace the data in the memory element 40.

Next, with reference to FIG. 6, a description will be made of a case where the image signal ΦDATA writes the high voltage (7V) under the condition that the voltages of the control lines ΦVCOMbar, ΦCLKbar, ΦVCOM and ΦCLK are low (0 V), low (0 V), high (5 V) and high (7 V), respectively.

Figure 6:
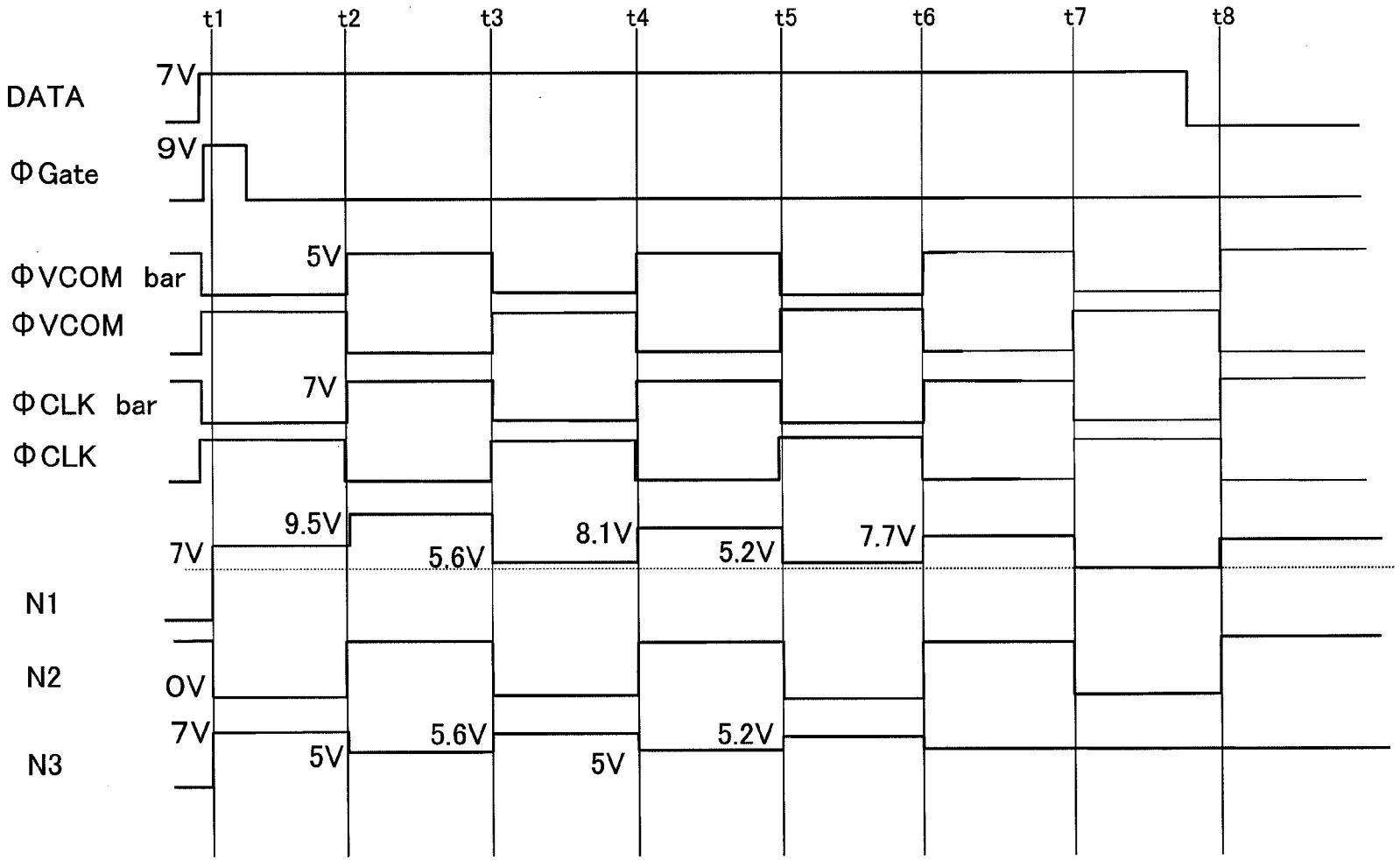
FIG. 6 is a timing chart showing the operation of the example of the invention.

At the time t1 in FIG. 6, the voltage of ΦGATE becomes high (9 V), so that the high voltage (7 V) of the image signal ΦDATA is captured at the node N1. At this point, the node N1 becomes 7 V and hence the nMOS transistor NM31 is turned on. Thus, the node N2 is brought into conduction with ΦVCOMbar (0 V), so that the node N2 becomes 0 V.

At this point, since the voltage of ΦCLKbar is low (0 V), the nMOS transistor NM21 is turned off, so that the node N2 is electrically isolated from the node N3. On the other hand, since the voltage of ΦCLK is high (7V), the nMOS transistor NM22 is turned on. Therefore, the node N3 is brought into conduction with the node N1, so that the voltage at the node N1, which is 7 V, is applied to the capacitor C1+C2.

At the time t2, the voltage of ΦCLK becomes low (0 V), so that the nMOS transistor NM22 is turned off to electrically isolate the node N1 from the node N3. On the other hand, since the voltage of ΦCLKbar is high (7 V), the nMOS transistor NM21 is turned on to bring the node N3 into conduction with the node N2.

Therefore, at the time t2, since the node N1 is electrically isolated from the capacitor C1+C2, by letting Vna2 be the voltage at the node N1 before isolation and considering that the voltage Vna2 increases the source voltage at the node N2 to 5 V and the parasitic capacitance C of the node N1 and the gate capacitance of the nMOS transistor NM31 are serially connected to provide a capacitance of ½C, the voltage Vnb2 after the isolation is determined by the following equation: Vnb2=Vna2+ΔV(N2)*½=7+5/2=9.5 V.

Therefore, the nMOS transistor NM31 is turned on, so that the node N2 is brought into conduction with the control line ΦVCOMbar (5 V) and hence the node N2 becomes 5 V. The nMOS transistor NM21 is also on, so that the node N3 also becomes 5 V.

At the time t3, ΦCLK becomes 7V, so that then MOS transistor NM22 is turned on to connect the node N1 to the capacitor C1+C2 via the nMOS transistor NM22.

Thus, by letting Vnc2 be the voltage at the node N1 after the connection, the following equation holds true: 9.5*2C+5*5C−5*C=7C*Vnc2, that is, Vnc2 is approximately 5.6 V.

At the time t4, since the node N1 is electrically isolated from the capacitor C1+C2, the voltage Vnd2 at the node N1 after the isolation is determined by the following equation: Vnd2=Vnc2+5*½C=5.6+5/2=8.1 V. At this point, the voltages at the nodes N2 and N3 are 5 V.

At the time t5, by letting Vne2 be the voltage at the node N1 after the node N1 is connected to the capacitor C1+C2, the following equation holds true: 8.1*2C+5*5C−5*C=7C*Vne2, that is, Vne2=36.2/7=5.2 V.

At the time t6, since the node N1 is electrically isolated from the capacitor C1+C2, by letting Vnf2 be the voltage at the node N1 after the isolation, the following equation holds true: Vnf2=Vne2+5*½=5.2+5/2=7.7 V.

At the time t7, since the node N1 is connected to the capacitor C1+C2 via the nMOS transistor NM22, by letting Vng2 be the voltage at the node N1 after the connection, the following equation holds true: 7.7*2C+5*5C−5*C=7C*Vng2, that is, Vng2=35.4/7=5.06 V, which is approximately 5 V.

At the time t8, since the node N1 is electrically isolated from the capacitor C1+C2, by letting Vnh2 be the voltage at the node N1 after the isolation, the following equation holds true: Vnh2=Vng2+5*½=5+5/2=7.5 V.

From then on, the voltage at the node N1 changes back and forth between 5 V and 7.5 V. Therefore, the node N1 keeps supplying the inverted display voltage (signal having a phase opposite to the counter voltage ΦVCOM) to the pixel electrode until ΦGATE becomes the on-voltage and the image signal ΦDATA is written to replace the data in the memory element 40.

Figure 7:
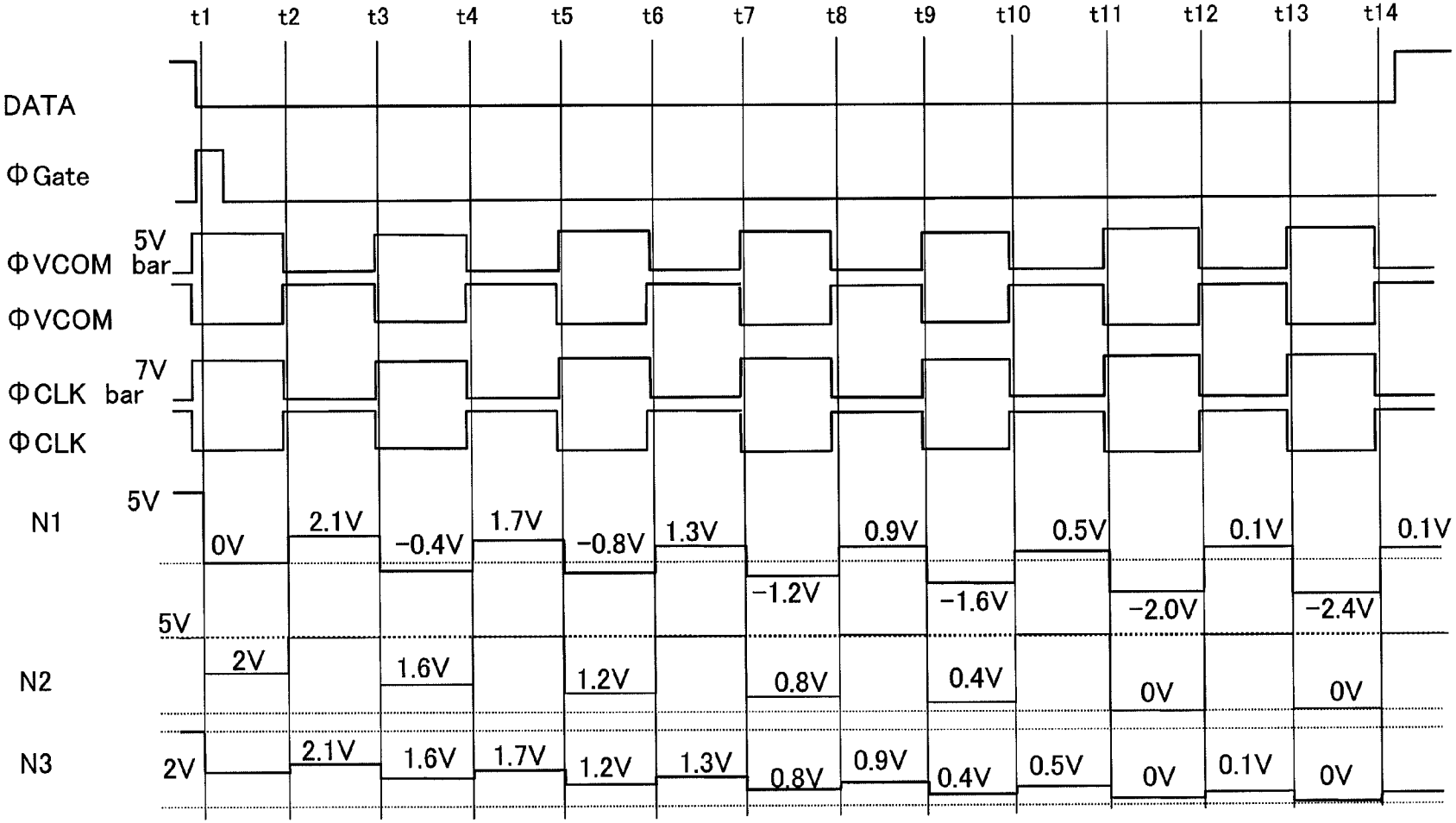
FIG. 7 is a timing chart showing the operation of the example of the invention.

With reference to FIG. 7, a description will be made of a case where the image signal ΦDATA is written at the low voltage (0 V) under the condition that the voltages of the control lines ΦVCOMbar, ΦCLKbar, ΦVCOM and ΦCLK are high (5 V), high (7 V), low (0 V) and low (0 V), respectively.

At the time t1, the voltage of the control line ΦGATE becomes high (9 V), so that the low voltage (0 V) of the image signal ΦDATA is written to the node N1. The pMOS transistor PM32 connected to the node N1 is turned on, so that the control line ΦVCOM (0 V) is connected to the node N2 via the pMOS transistor PM32.

When the voltage of the node N2 is high (5 V) before the time t1, the threshold voltage of the pMOS transistor PM32, which is 2 V, remains at the node N2, so that the voltages at the nodes N2 and N3 become 2 V. Since the nMOS transistor NM22 is off, the node N1 is electrically isolated from the capacitor C1+C2.

At the time t2, the voltages of the control lines ΦVCOMbar, ΦCLKbar, ΦVCOM and ΦCLK are low (0 V), low (0 V), high (5 V) and high (7 V), respectively, so that the node N1 is electrically connected to the capacitor C1+C2. The pMOS transistor PM32 is turned on to connect the control line ΦVCOM (5 V) to the node N2 via the pMOS transistor PM32, so that the voltage at the node N2 becomes 5 V.

By letting Vna3 be the voltage at the node N1 after the connection, the following equation holds true: 0*2C+2*5C+5*C=7C*Vna3, that is, Vna3=15/7=2.1 V.

At the time t3, the voltages of the control lines ΦVCOMbar, ΦCLKbar, ΦVCOM and ΦCLK are high (5 V), high (7 V), low (0 V) and low (0 V), respectively, so that the node N1 is electrically isolated from the capacitor C1+C2. By letting Vnb3 be the voltage at the node N1 after the isolation, the following equation holds true: Vnb3=Vna3+(−5)*½=−0.4 V.

At this point, the node N2 is connected to the control line ΦVCOM (0 V) via the pMOS transistor PM32. However, the voltage at the node N1 is −0.4 V, so that the voltage remaining at the node N2 decreases from the threshold value by 0.4 V to 1.6 V.

At the time t4, the node N1 is connected to the capacitor C1+C2 via the nMOS transistor NM22. By letting Vnc3 be the voltage at the node N1 after the connection, the following equation holds true: −0.4*2C+1.6*5C+5*C=7C*Vnc3, that is, Vnc3=1.7 V.

At the time t5, since the node N1 is electrically isolated from the capacitor C1+C2, by letting Vnd3 be the voltage at the node N1 after the isolation, the following equation holds true: Vnd3=Vnc3+(−5)*½=−0.8 V. The voltage remaining at the node N2 decreases from the threshold value by 0.8 V to 1.2 V.

At the time t6, the node N1 is connected to the capacitor C1+C2 via the nMOS transistor NM22. By letting Vne3 be the voltage at the node N1 after the connection, the following equation holds true: −0.8*2C+1.2*5C+5*C=7C*Vne3, that is, Vne3=1.3 V.

At the time t7, since the node N1 is electrically isolated from the capacitor C1+C2, by letting Vnf3 be the voltage at the node N1 after the isolation, the following equation holds true: Vnf3=Vne3+(−5)*½=−1.2 V. The voltage remaining at the node N2 decreases from the threshold value by 1.2 V to 0.8 V.

At the time t8, the node N1 is connected to the capacitor C1+C2 via the nMOS transistor NM22. By letting Vng3 be the voltage at the node N1 after the connection, the following equation holds true: −1.2*2C+0.8*5C+5*C=7C*Vng3, that is, Vng3=0.9 V.

At the time t9, since the node N1 is electrically isolated from the capacitor C1+C2, by letting Vnh3 be the voltage at the node N1 after the isolation, the following equation holds true: Vnh3=Vng3+(−5)*½=−1.6 V. The voltage remaining at the node N2 decreases from the threshold value by 1.6 V to 0.4 V.

At the time t10, the node N1 is connected to the capacitor C1+C2 via the nMOS transistor NM22. By letting Vni3 be the voltage at the node N1 after the connection, the following equation holds true: −1.6*2C+0.4*5C+5*C=7C*Vni3, that is, Vni3=0.5 V.

At the time t11, since the node N1 is electrically isolated from the capacitor C1+C2, by letting Vnj3 be the voltage at the node N1 after the isolation, the following equation holds true: Vnj3=Vni3+(−5)*½=−2.0 V. The voltage remaining at the node N2 decreases from the threshold value by 2.0 V to 0.0 V.

At the time t12, the node N1 is connected to the capacitor C1+C2 via the nMOS transistor NM22. By letting Vnk3 be the voltage at the node N1 after the connection, the following equation holds true: −2.0*2C+0*5C+5*C=7C*Vnk3, that is, Vnk3=0.1 V.

At the time t13, since the node N1 is electrically isolated from the capacitor C1+C2, by letting Vnl3 be the voltage at the node N1 after the isolation, the following equation holds true: Vnl3=Vnk3+(−5)*½=−2.4 V. The voltage remaining at the node N2 becomes the voltage of the control line ΦVCOM, which is 0 V.

At the time t14, the node N1 is connected to the capacitor C1+C2 via the nMOS transistor NM22. By letting Vnm3 be the voltage at the node N1 after the connection, the following equation holds true: −2.4*2C+0*5C+5*C=7C*Vnm3, that is, Vnm3=0 V.

At the time t13, since the node N1 is electrically isolated from the capacitor C1+C2, by letting Vnn3 be the voltage at the node N1 after the isolation, the following equation holds true: Vnn3=Vnm3+(−5)*½=−2.5 V. The voltage remaining at the node N2 becomes the voltage of the control line ΦVCOM, which is 0 V.

From then on, the voltage at the node N1 changes back and forth between −2.5 V and 0 V. Therefore, the node N1 keeps supplying the non-display voltage (signal in phase with the counter voltage ΦVCOM) to the pixel electrode until ΦGATE becomes the on-voltage and the image signal ΦDATA is written to replace the data in the memory element 40.

Figure 8:
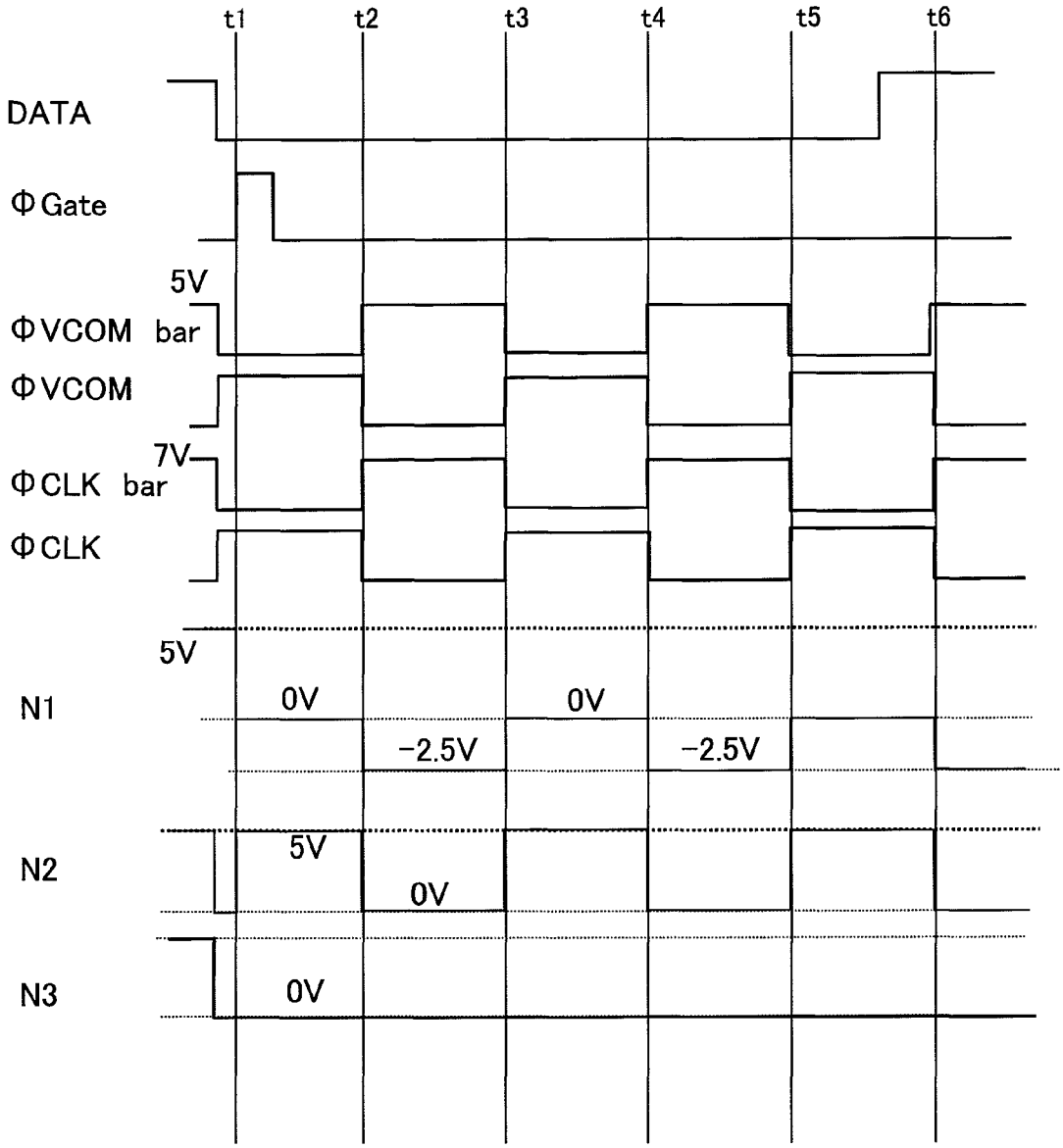
FIG. 8 is a timing chart showing the operation of the example of the invention.

Next, with reference to FIG. 8, a description will be made of a case where the image signal ΦDATA is written at the low voltage (0 V) under the condition that the voltages of the control lines ΦVCOMbar, ΦCLKbar, ΦVCOM and ΦCLK are low (0 V), low (0 V), high (5 V) and high (7 V), respectively.

At the time t1, since the voltage of the control line ΦGATE becomes high (9 V), the low voltage (0 V) of the image signal ΦDATA is written to the node N1. The pMOS transistor PM32 connected to the node N1 is turned on, so that the control line ΦVCOM (5 V) is connected to the node N2 via the pMOS transistor PM32, and hence the node N2 becomes 5 V.

Since the nMOS transistor NM22 is on, the node N1 is electrically connected to the capacitor C1+C2 via the nMOS transistor NM22.

At the time t2, the voltages of the control lines ΦVCOMbar, ΦCLKbar, ΦVCOM and ΦCLK are high (5 V), high (7 V), low (0 V) and low (0 V), respectively, so that the node N1 is electrically isolated from the capacitor C1+C2. Therefore, by letting Vna4 be the voltage at the node N1 after the isolation, the following equation holds true: Vna4=0+(−5)*½=−2.5 V.

At this point, the voltage of −2.5 V is applied to the gate terminal of the pMOS transistor PM32, so that the node N2 is connected to ΦVCOM (0 V) via the pMOS transistor PM32, and hence the voltage at the node N2 becomes 0 V.

At the time t3, since the node N1 is connected to the capacitor C1+C2 via the nMOS transistor NM22, by letting Vnb4 be the voltage at the node N1 after the connection, the following equation holds true: −2.5*2C+0*5C+5*C=7C*Vnb4, that is, Vnb4=0/7=0 V.

From then on, the voltage at the node N1 changes back and forth between −2.5 V and 0 V. Therefore, the node N1 keeps supplying the non-display voltage (signal in phase with the counter voltage ΦVCOM) to the pixel electrode until ΦGATE becomes the on-voltage and the image signal ΦDATA is written to replace the data in the memory element 40.

According to this example, by holding display/non-display data in the pixel memory in the form of voltage and outputting the display voltage/non-display voltage to the pixel electrode, the alternating drive of the liquid crystal display device is possible without rewriting the display data through the drive circuit, the image signal line and the like. The layout area required for the pixel memory can also be reduced. Even in the case of multi-bit data, a high aperture-ratio pixel memory can be provided.

The invention claimed is:

1. A liquid crystal display device comprising:

a substrate;

a plurality of pixels each including a pixel electrode provided on the substrate;

each pixel including a counter electrode disposed opposite to each of the pixel electrodes to receive a first series of periodically oscillating clock pulses;

each pixel including a memory element electrically connected to the pixel electrode;

each pixel including a first switching element electrically connected to the memory element;

an image signal line to supply an image signal to the first switching element;

a scan signal line to supply a scan signal that controls the first switching element;

a capacitive element provided in the memory element;

the memory element including an output circuit comprising a first nMOS switching element and a first pMOS switching element, the first nMOS switching element and the first pMOS switching element having a common control terminal to which a voltage held in the capacitive element is supplied and a common output terminal connected to the pixel electrode, wherein a first input electrode of the first pMOS switching element is supplied with the first series of periodically oscillating clock pulses and a first input electrode of the first nMOS switching element is supplied with a second series of periodically oscillating clock pulses, the first series of periodically oscillating clock pulses and the second series of periodically oscillating clock pulses having opposite phase;

the memory element further including a second nMOS switching element and a third nMOS switching element electrically connected between the output circuit and the capacitive element, the second nMOS switching element and the third nMOS switching element being connected in series between the first switching element and the pixel electrode;

a display-voltage supply line to supply a display voltage corresponding to the second series of periodically oscillating clock pulses to the input electrode of the first nMOS switching element of the output circuit; and a non-display voltage line to supply a non-display voltage corresponding to the first series of periodically oscillating clock pulses to the input electrode of the first pMOS switching element of the output circuit, wherein:

the first switching element is turned on to supply the image signal to the memory element so that the voltage held in the capacitive element indicates one of a display state and a non-display state, wherein the display state is a state in which a potential difference between the counter electrode and the pixel electrode is maximum and the non-display state is a state in which the potential difference between the counter electrode and the pixel electrode is minimum, the first switching element is turned off to supply the voltage held in the capacitive element to the control terminal of the output circuit, when the image signal indicates a display state, the output circuit outputs the display voltage corresponding to the second series of periodically oscillating clock pulses to the pixel electrode, when the image signal indicates a non-display state, the output circuit outputs the non-display voltage corresponding to the first series of periodically oscillating clock pulses to the pixel electrode, when the image signal indicates the display state, the capacitive element holds a voltage that causes the output circuit to output the display voltage, when the image signal indicates the non-display state, the capacitive element holds a voltage that causes the output circuit to output the non-display voltage, and a control electrode of the second nMOS switching element is electrically connected to a first terminal of a first capacitor of the capacitive element and a first control signal line that supplies a first control clock pulse, and a control electrode of the third nMOS switching element is electrically connected to a first terminal of a second capacitor of the capacitive element and a second control signal line that supplies a second control clock pulse having opposite phase of the first control clock pulse, wherein a second terminal of the first capacitor and second terminal of the second capacitor are commonly connected between the second nMOS switching element and the third nMOS switching element, and an output electrode of the third nMOS switching transistor is commonly connected to the pixel electrode and the common output terminal of the output circuit.

2. A liquid crystal display device comprising:

a substrate having a plurality of pixels arranged in a matrix to form a display area;

a pixel electrode formed in each of the pixels;

each pixel including a counter electrode disposed opposite to the pixel electrode to receive a counter voltage that periodically oscillates between a first voltage and a second voltage;

a first switching element provided in each of the pixels;

an image signal line to supply an image signal to the first switching element;

a scan signal line to supply a scan signal that controls the first switching element;

each pixel including a memory element connected to the pixel electrode to which the image signal is supplied via the first switching element;

a capacitive element provided in the memory element; and the memory element including an output circuit comprising a first nMOS switching element and a first pMOS switching element, the first nMOS switching element and the first pMOS switching element having a common control terminal to which a voltage held in the capacitive element is supplied and a common output terminal that outputs the first and second voltages to the pixel electrode, wherein a first input electrode of the first pMOS switching element is supplied with the counter voltage and a first input electrode of the first nMOS switching element is supplied with a reverse counter voltage that periodically oscillates between the second voltage and the first voltage in opposite phase of the counter voltage;

the memory element further including a second nMOS switching element and a third nMOS switching element electrically connected between the output circuit and the memory element the second nMOS switching element and the third nMOS switching element being connected in series between the first switching element and the pixel electrode;

wherein:

the image signal is 1-bit data indicative of on and off information respectively corresponding to a display state and a non-display state, wherein the display state is a state in which a potential difference between the counter electrode and the pixel electrode is maximum and the non-display state is a state in which the potential difference between the counter electrode and the pixel electrode is minimum, the first switching element is turned on to supply the image signal to the memory element, the first switching element is turned off to hold a voltage in the memory element based on the on and off information of the image signal, the held voltage is supplied to a control terminal of the output circuit, when the image signal indicates the on information and the first voltage is supplied to the counter electrode, the second voltage is supplied to the pixel electrode, when the image signal indicates the off information and the first voltage is supplied to the counter electrode, the first voltage is supplied to the pixel electrode, the first voltage or the second voltage is supplied by the second switching element from the output circuit to the memory element, and a control electrode of the second nMOS switching element is electrically connected to a first terminal of a first capacitor of the capacitive element and a first control signal line that supplies a first control clock pulse, and a control electrode of the third nMOS switching element is electrically connected to a first terminal of a second capacitor of the capacitive element and a second control signal line that supplies a second control clock pulse having opposite phase of the first control clock pulse, wherein a second terminal of the first capacitor and second terminal of the second capacitor are commonly connected between the second nMOS switching element and the third nMOS switching element, and an output electrode of the third nMOS switching transistor is commonly connected to the pixel electrode and the common output terminal of the output circuit.

3. The liquid crystal display device according to claim 2, further comprising a reverse counter voltage line to supply the reverse counter voltage.

4. The liquid crystal display device according to claim 3, wherein the output circuit is formed of an inverter circuit connected between a control signal line that supplies the counter voltage and the reverse counter voltage line.

5. A liquid crystal display device comprising:

a substrate;

a plurality of image signal lines and a plurality of scan lines formed on the substrate and arranged so as to intersect with each other; and a plurality of pixels formed on the substrate and arranged at intersections of the image signal lines and the scan lines, each pixel comprising a switch element arranged at an intersection of an image signal line and a scan line to supply an image signal based on a scan signal via the scan line, a pixel electrode disposed opposite to a counter electrode provided on the substrate to receive clock pulses, and a memory element disposed between the switch element and the pixel electrode to hold the image signal indicative of one of a display state and a non-display state, wherein the display state is a state in which a potential difference between the counter electrode and the pixel electrode is maximum and the non-display state is a state in which the potential difference between the counter electrode and the pixel electrode is minimum, wherein the memory element comprises a capacitive element disposed between a first pair of control signal lines in parallel to the scan line to hold the image signal during one of the display state and the non-display state based on a first pair of control signals of opposite phases; and a display voltage output circuit disposed between a second pair of control signal lines in parallel to the scan line to output one of a display voltage and a non-display voltage to the pixel electrode based on a second pair of control signals of opposite phases, the display voltage output circuit comprising a first nMOS switching element and a first pMOS switching element, the first nMOS switching element and the first pMOS switching element having a common control terminal to which a voltage held in the capacitive element is supplied and a common output terminal connected to the pixel electrode, wherein a first input electrode of the first pMOS switching element is supplied with one voltage signal of the second pair of control signals and a first input electrode of the first nMOS switching element is supplied with another voltage signal of the second pair of control signals, the memory element further including a second nMOS switching element and a third nMOS switching element electrically connected between the output circuit and the capacitive element, the second nMOS switching element and the third nMOS switching element being connected in series between the first switching element and the pixel electrode, wherein, when the image signal indicates the display state, the capacitive element holds the image signal that causes the display voltage output circuit to output the display voltage to the pixel electrode, and when the image signal indicates the non-display state, the capacitive element holds the image signal that causes the display voltage output circuit to output the non-display voltage to the pixel electrode, wherein a control electrode of the second nMOS switching element is electrically connected to a first terminal of a first capacitor of the capacitive element and is supplied with one voltage signal of the first pair of control signals, and a control electrode of the third nMOS switching element is electrically connected to a first terminal of a second capacitor of the capacitive element and a is supplied with another voltage signal of the first pair of control signals, wherein a second terminal of the first capacitor and second terminal of the second capacitor are commonly connected between the second nMOS switching element and the third nMOS switching element, and an output electrode of the third nMOS switching transistor is commonly connected to the pixel electrode and the common output terminal of the display voltage output circuit.

6. The liquid crystal display device according to claim 5, further comprising a scan line drive circuit and an image signal line drive circuit are provided on the substrate to supply the scan signal and the image signal, via the scan lines and the image signal lines.

7. The liquid crystal display device according to claim 6, further comprising a flexible substrate having input terminals operatively connected to the scan line drive circuit and the image signal line drive circuit, and a control circuit arranged to control operation of the scan line drive circuit and the image signal line drive circuit and supply control signals and the image signal to each of the pixels provided on the substrate.

8. The liquid crystal display device according to claim 6, wherein the plurality of pixels are formed in a matrix within a display area on the substrate, and the scan line drive circuit and the image signal line drive circuit are formed in a periphery of the display area along edges of the substrate and are alternating driven without rewriting the image signal via the scan line drive circuit and the image signal line drive circuit when one of the display voltage and the non-display voltage is output to the pixel electrode of each pixel on the substrate.

* * * * *